US005083593A

United States Patent [19]

Fogg

[11] Patent Number: 5,083,593

[45] Date of Patent: Jan. 28, 1992

[54] FLIP-FLOP SEAL

[75] Inventor: Michael T. Fogg, Holland, Mich.

[73] Assignee: Fogg Filler Co., Holland, Mich.

[21] Appl. No.: 590,338

[22] Filed: Sep. 28, 1990

Related U.S. Application Data

[63] Continuation of Ser. No. 410,669, Sep. 21, 1989, abandoned.

[51] Int. Cl.[5] ..... B65B 3/04

[52] U.S. Cl. ..... 141/295; 141/37; 141/275; 92/240; 277/188 R

[58] Field of Search ..... 277/188 R, 152, 188 A; 92/240–246, 51, 52; 141/290–296, 301, 37, 44, 45, 59, 148, 152, 149, 172, 269, 281, 275–278, 302, 305, 309, 368, 351–354; 251/347, 348

[56] References Cited

U.S. PATENT DOCUMENTS

| | | | |
|---|---|---|---|
| 1,983,682 | 12/1934 | Sheaffer | 277/188 R |
| 2,093,365 | 9/1937 | Ransom et al. | 141/353 |
| 2,361,641 | 10/1944 | McKinnis | 141/302 |
| 2,364,400 | 12/1944 | Stewart et al. | 141/59 |
| 2,368,744 | 2/1945 | Carey | 277/188 A |
| 2,384,305 | 9/1945 | Herron | 277/188 R |
| 2,501,764 | 3/1950 | Duer | 141/295 X |
| 2,633,808 | 4/1953 | Webber | 92/242 |
| 2,904,115 | 9/1959 | Turner | 277/188 R |
| 2,974,983 | 3/1961 | Meyer | 277/188 R |
| 3,395,619 | 8/1968 | Grebe | 92/51 |
| 3,450,171 | 6/1969 | Takiguchi | 141/302 X |
| 3,871,425 | 3/1975 | Fee et al. | 141/295 X |
| 3,885,608 | 5/1975 | Ayres | 141/354 |
| 3,955,371 | 5/1976 | Bueler | 92/51 X |
| 4,025,149 | 5/1977 | Spinner | 277/188 R X |
| 4,249,458 | 2/1981 | Massing | 92/51 X |
| 4,714,259 | 12/1987 | Mack et al. | 277/188 R X |
| 4,809,991 | 3/1989 | Blatt | 277/188 R X |
| 4,924,759 | 5/1990 | Plummer | 92/240 |

FOREIGN PATENT DOCUMENTS

| | | | |
|---|---|---|---|
| 0504704 | 8/1951 | Belgium | 92/240 |
| 0551827 | 6/1932 | Fed. Rep. of Germany | 141/292 |
| 1047641 | 12/1958 | Fed. Rep. of Germany | 92/242 |
| 2113392 | 10/1971 | Fed. Rep. of Germany | 277/188 R |
| 1035840 | 8/1953 | France | 141/353 |
| 0555197 | 8/1943 | United Kingdom | 141/353 |
| 0578954 | 7/1946 | United Kingdom | 277/188 R |

*Primary Examiner*—Ernest G. Cusick
*Assistant Examiner*—Casey Jacyna
*Attorney, Agent, or Firm*—Price, Heneveld, Cooper, DeWitt & Litton

[57] ABSTRACT

A low-resistance, liquid-tight seal for use in a valve having a nozzle that telescopes into an axial fluid passage in a valve body. The nozzle has a peripheral portion of reduced diameter near one end thereof for supporting a flat annular seal. The inner edge of the annular seal grips the nozzle while the outer portion of the seal undergoes a flip-flop action against the inner wall of the valve body as the nozzle moves in an out of the valve body. A closure can be provided for the nozzle which is opened by movement of the nozzle into the valve body and closed by the return motion of the nozzle.

An improved valve and bottle-filling machine is provided for containers with low-crush resistance. The annular flip-flop seal provides a low resistance to movement when a container is used to push the nozzle into the valve body opening the fluid passage for filling the container.

4 Claims, 3 Drawing Sheets

FLIP-FLOP SEAL

This is a continuation of co-pending application Ser. No. 07/410,669 filed on Sept. 21, 1989.

BACKGROUND OF THE INVENTION

The present invention relates to a liquid-tight seal for use in a valve primarily intended to carry liquids and particularly liquids of poor lubricating qualities such as water, solvents, fruit juices and the like.

In the past it has been common practice to use the familiar "O" ring to provide a liquid-tight seal in a valve. "O" ring seals have proved outstanding over the years in many applications but have the inherent limitation of high drag especially when used in applications where the fluid to be sealed has poor lubricating qualities. If one portion of a valve has to move in a telescoping manner within a valve body and an "O" ring is used to provide the seal, the "O" ring tends to inhibit movement by gripping the wall and tending to distort, increasing its surface area and in turn the amount of contact surface providing a frictional grip.

When an "O" ring seal is used in the valve body of a fill nozzle on a bottle-filling machine a serious problem can result. Plastic containers are very popular and because of the material costs involved the containers are continually being made thinner and lighter. Lighter container weight means less structural strength and as a result containers tend to crush as they are raised up and pressed against the filling nozzle to telescope it open. The major source of resistance to the telescoping of the fill nozzle is the "O" ring seal. The filling nozzle is normally closed with a return spring as the container lowers away when the fill process is finished. The friction caused by the "O" ring may reach 15 pounds and has to be overcome by the container in opening the valve. The return spring tension should preferably exceed the "O" ring friction to close the nozzle by at least 5 pounds, that is, a 20 pound spring. This means that the overall pressure which must be overcome by the bottle is the total of the two, that is 35 pounds. Most lightweight containers, however, cannot withstand over 20 pounds of top loading and thus may become crushed before the valve opens.

In an attempt to overcome the problems created through the use of the "O" ring seal, bellows or diaphragm type seals have been used. A bellows has equal friction in both directions; however, it must have sufficient resiliency to return the fill nozzle to the closed position after the contained is filled. The bellows or diaphragm also presents problems in that it is a complex molded part which is difficult to remove from the core during molding. The bellows relies on its inherent resiliency to obviate the need for a return spring. It has been found, however, that heat and chemicals reduce the effectiveness or the resiliency of the bellows in only a few days. It is also substantially more expensive to replace than the "O" ring and is not moldable in a wide range of materials and, therefore, has limited chemical applications.

SUMMARY OF THE INVENTION

In accordance with the present invention, a low resistance liquid-tight seal is provided for use in applications where a portion of a valve moves within a passage in a valve body. The low resistance seal is particularly useful in automatic bottle-filling applications where a container with low crush resistance is used to push open the valve controlling the flow of liquid into the container. The low resistance to movement is obtained through the use of an annular flexible seal that grips the movable portion of the valve to provide one seal and that slides along in a flip-flop type action against the fixed valve body to provide a second fluid-tight seal. The flip-flop type action of the flexible seal enables it to orient itself in the direction of least resistance to movement each time the movable portion of the valve moves. The extremely low resistance of the flip-flop liquid seal, approximately 1 pound, enables a container of low crush resistance to withstand the force necessary to open the valve against the pressure of the liquid-tight seal and the return spring used to close the valve.

The liquid-tight seal is particularly useful in a valve having a valve body with a liquid passage therethrough and a nozzle having an elongated body for movement in the liquid passage in the valve body. The portion of the nozzle which moves within the valve body has a peripheral portion of reduced diameter near the end remote from the exit of the nozzle. A flat annular seal member made of a flexible resilient material having an aperture therein is sized to fit on and to be carried by the reduced portion of the nozzle to form a liquid-tight seal against the nozzle and to extend outwardly substantially normal to the nozzle. The flat annular member forms a liquid-tight seal between the movable nozzle and the valve body.

The low resistance flip-flop seal is particularly useful with a bottle-filling machine having a container for supporting a volume of liquid to be dispensed and at least one valve for controlling the discharge of liquid from the container. Each of the valves has a valve body with a liquid passage therethrough. A movable member is positioned in the passage in the valve body and is adapted to move in a reversible manner in the passage. The movable member has a peripheral portion of reduced diameter and an annular substantially flat flexible resilient sealing member is disposed on this peripheral portion of reduced diameter and forms a liquid-tight seal and projects outwardly therefrom to form a second liquid-tight seal between the valve body and the movable member. A closure is provided for the valve. The valve is opened when the movable member is moved by a container to be filled away from the closure in a direction into the valve body. A return spring is provided for the movable member for moving the movable member in a direction out of the valve body and back against the closure to close the valve when a container is removed from the valve.

DETAILED DESCRIPTION OF THE PREFERRED EMBODIMENTS

Figure 1:
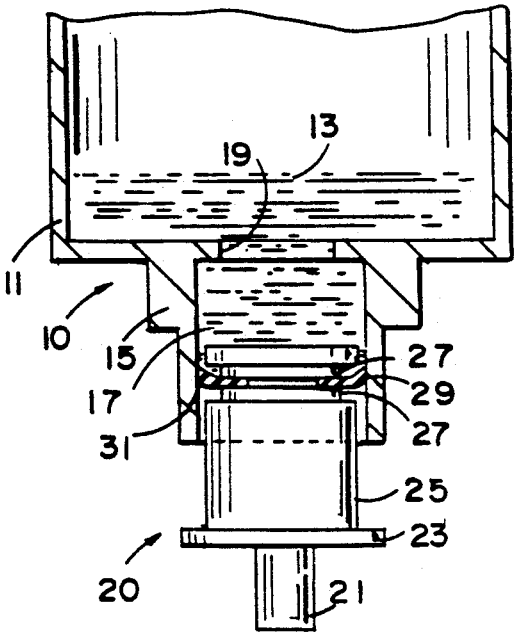
FIG. 1 is a schematic view showing the basic components of the low resistance valve as they would appear when the valve is closed with the movable nozzle moved out from the valve body, the additional components making up a complete valve are not included in order to more clearly show the resilient flexible flip-flop seal.

Referring to FIG. 1, the improved valve and liquid-tight seal of the present invention is shown and indicated generally by the number 10. The valve is shown in association with a supply tank 11 holding a liquid 13 which is to be dispensed through the valve. The valve has a body portion 15 which is shown connected to the bottom of the supply tank 11 in a schematic representation. The valve body 15 has an axial sleeve or liquid passage 17 which communicates through a port 19 with the liquid in the supply tank 11. The valve in FIG. 1 is shown with the nozzle portion indicated generally by the number 20, in the position the nozzle would occupy when the valve is closed. The nozzle 20 has an axial passage therethrough which is not shown.

The nozzle has a portion 21 for insertion into the neck of a container to be filled. The container would press upwardly against the shoulder 23 of the nozzle to open the valve. The nozzle has a body portion 25 and two stepped reduced portions 27 and 29 for supporting an annular seal member 31. The valve can be made of food grade materials such as certain plastics, for example polyetheylene, and polycarbonate preferably from stainless steel. The nozzle 20 moves in and out of the liquid passage 17 in the valve body 15. In order to reduce the friction or the resistance to movement of the nozzle, a liquid-tight seal 31 is provided in the form of a flat annular ring. The inner edge 33 of the seal 31, as shown more clearly in FIG. 4, grips the bottom of the reduced portion 29 forming a liquid-tight seal between the annular ring 31 and the nozzle body 25. The outer edge 35 contacts the inner wall of the liquid passage 17 in the valve body 15. As the nozzle 20 moves within the valve body the liquid-tight seal 31 orients itself in the direction of least resistance in a flip-flop like manner.

Figure 2:
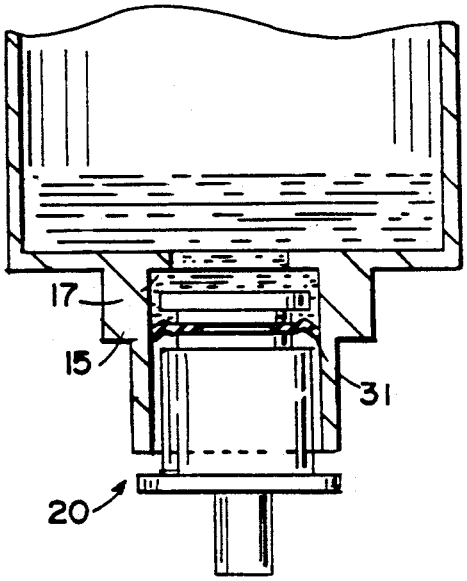
FIG. 2 is a view of the same components shown in FIG. 1 with the movable nozzle moving into the valve body.

As shown in FIG. 2, as the nozzle 20 moves upward in the fluid passage 17 in the valve body 15, the seal 31 undergoes a transition from the configuration shown in FIG. 1. As shown in FIG. 2, the seal 31 tends to bellows or ripple between the nozzle and the valve body as it is forced backward into the reduced portion 27 of the nozzle.

Figure 3:
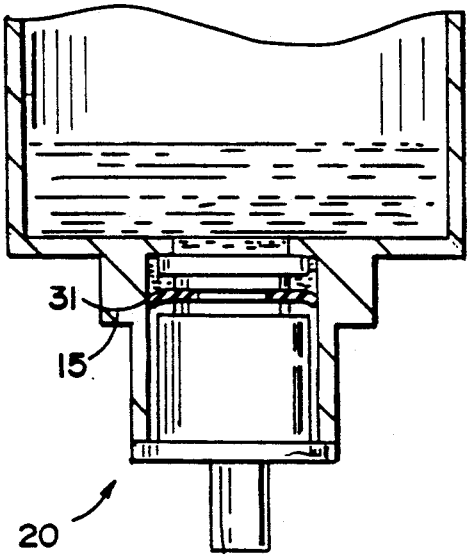
FIG. 3 is a view of the movable nozzle in the fully open condition.

Referring to FIG. 3, the nozzle 20 is shown fully seated in the valve body 15 with the seal 31 completely reversed from the direction shown in FIG. 1. The seal 31 undergoes a flip-flop transition as the nozzle moves in a reciprocating manner into and out of the valve body as a container to be filled pushes upwardly to open the valve, and then a return spring not shown in FIGS. 1, 2 and 3 returns the nozzle 20 to the position shown in FIG. 1.

The portions 27 of reduced diameter on each side of the seal 31 provide room for the seal to bellows as shown in FIG. 2, and also provide room for the seal to undergo the flip-flop action without becoming pinched between the nozzle body 25 and the wall of the valve body forming the liquid passage 17.

In FIGS. 1, 2 and 3, the parts have been exaggerated for clarity. It should be noted, however, that the seal 31 moves within the reduced portion 27 of the nozzle body 25 and does not extend outwardly normal to the nozzle far enough so that the seal 31 could become pinched between the moving nozzle 20 and the inner wall of the valve body. The seal 31 is supported on the nozzle 25 by the resiliency or elastic memory of the seal. It is not gripped as in the usual manner between a pair of rigid washers where the seal is tightly clamped in place. The walls separating the reduced portion 29 from the reduced portions 27 on either side of the seal assist in holding the seal in place so that it does not slide along the valve body. The gripping action of the seal on the valve body provides the liquid-tight seal.

The seal 31 can be made of many different compatible resilient materials. For example, the seal can be made of silicone rubber, neoprene rubber, Buna type rubber, and of white neoprene type rubber. Many different types of materials can be used with the primary concern being the compatibility between the material and the liquid to be dispensed from the container.

Figure 4:
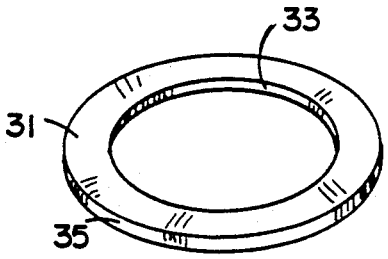
FIG. 4 is a perspective view of a die stamped flip-flop seal.
Figure 6:
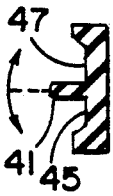
FIG. 6 is a sectional view of the molded flip-flop seal of FIG. 5 with directional arrows schematically illustrating the flip-flop action.
Figure 5:
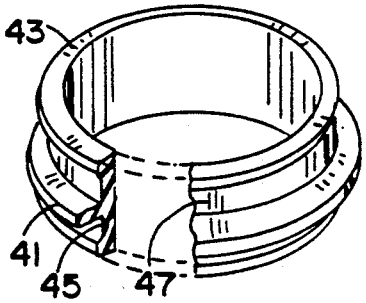
FIG. 5 is a perspective view of a molded flip-flop seal.

The seal shown in FIG. 4 can be made by merely stamping or die cutting the part from a sheet of the selected resilient material. As shown in FIG. 5, the seal can also be made through a conventional molding process of a molded resilient material. The molded seal has a resilient blade 41 projecting from the side. On either side of the blade 41 the collar 43 is reduced at 45 and 47 to provide room for the blade 41 to flip-flop as the seal moves along with the nozzle in the valve body. When the molded seal is used it is unnecessary to machine the nozzle in a stepped reduced manner as shown in FIGS. 1, 2 and 3. The nozzle need only be reduced sufficiently to provide room for the molded seal 43 to be recessed so that the blade 41 contacts the inner wall of the liquid passage in the valve body without exerting unnecessary resistance against the wall of the passage. The molded seal can be made approximately ⅜ inch in length with an inner wall thickness of approximately 1/16 inch, and with an overall thickness from the inner wall to the outer edge of the blade of approximately ⅛ inch. These dimensions are representative of a working seal. If the valve is larger or smaller, the dimensions can be easily varied to meet the necessary requirements.

Figure 7:
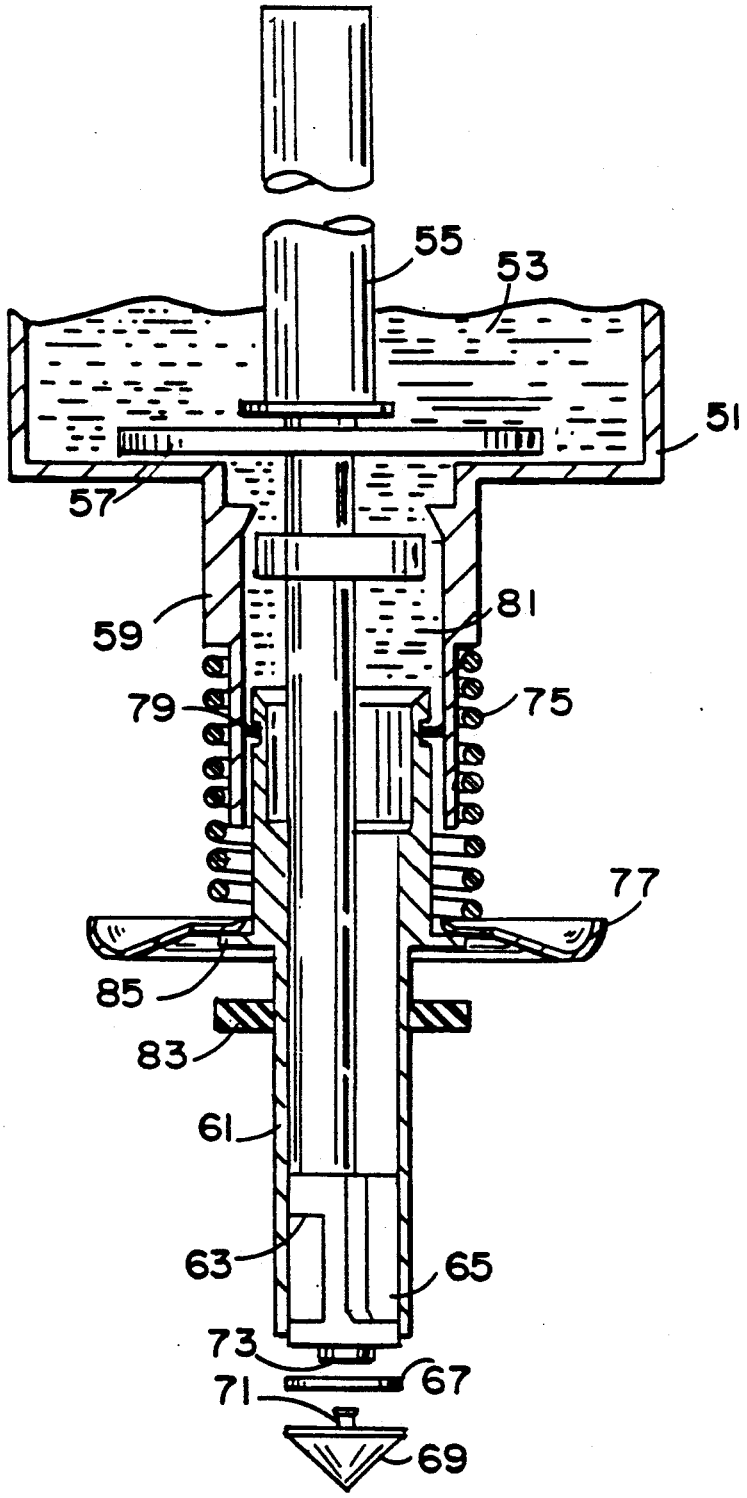
FIG. 7 is a partially exploded view of a valve for use in an automatic bottle-filling machine.

As mentioned previously, the valve of FIGS. 1, 2 and 3 was represented in a simplified schematic manner with parts unnecessary to the description of the operation of the seal 31 not being shown. Now referring to FIG. 7, a working valve is shown incorporating the flip-flop seal. In FIG. 7, a supply tank 51 is shown containing a liquid 53 to be dispensed through the valve. A vent tube 55 extends through the valve and through the liquid in the supply tank 51 and preferably above the surface of the liquid in the container. A clip 57 is fastened about the vent tube and supports it in position. The valve body 59 is shown attached to the bottom of the supply tank 51. The movable nozzle 61 is shown in the position it would occupy when the valve of FIG. 7 is closed. At the remote end of the vent tube 55, an air entry port 63 is provided to allow air to vent from a container being filled, while the liquid passes down through the interior of this nozzle 61 and out through a fluid directing portion 65 at the bottom of the vent tube. A resilient seal or closure 67 is fastened to the end of the vent tube 55 by a pointed guide 69. The pointed guide has a threaded extension 71 on the side opposite the point, which can be threaded into a threaded aperture 73 located on the end of the vent tube 55, to hold the closure 67 in place. The guide 69 is preferably made of resilient material and helps to align containers to be filled with the nozzle. The closure 67 can be made of neoprene rubber or Teflon or other compatible materials. When the nozzle is closed, the bottom edge of the nozzle 61 is pressed tightly against the closure 67 by the return spring 75 which is fitted about the valve body 59. A drip collar 77 is provided to capture any liquid which might escape past the flip-flop seal 79, or which may be wiped off the wall of the fluid passage 81 in the valve body, as the liquid seal 79 moves in a windshield wiper like action.

Figure 8:
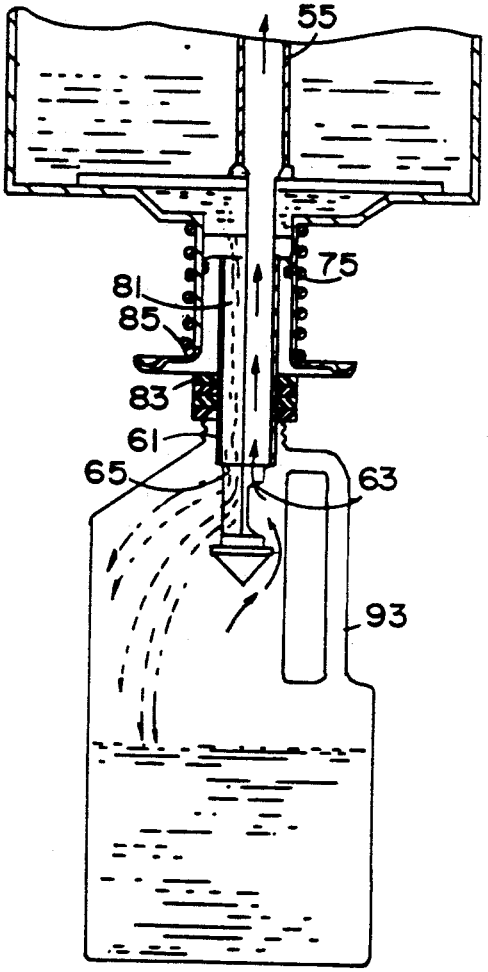
FIG. 8 is a sectional view showing the valve of a bottle-filling machine in an open condition.
Figure 9:
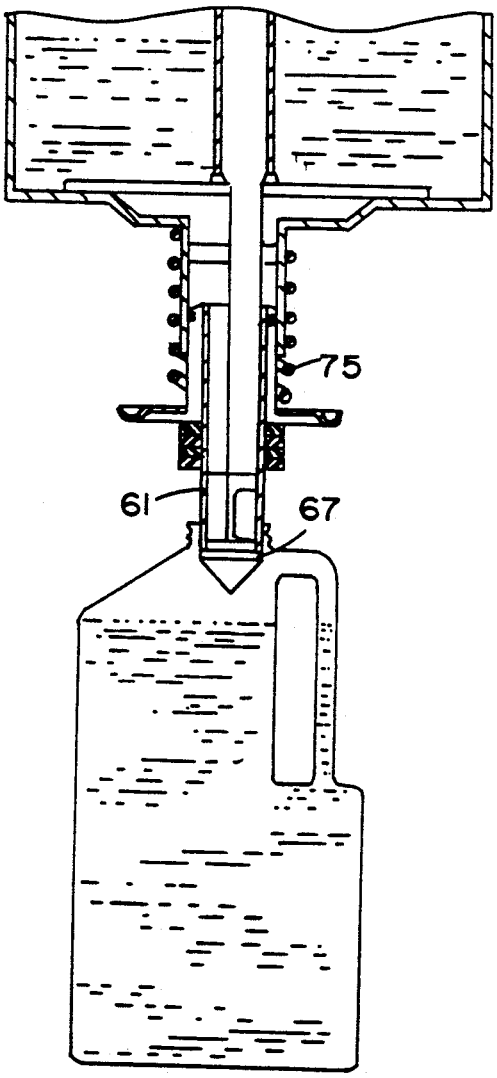
FIG. 9 is a sectional view showing the valve of a bottle-filling machine in a closed condition.

Referring to FIGS. 8 and 9, a filling station of a bottle-filling machine is shown. A container 93 to be filled on the bottle-filling machine would be aligned with the nozzle 61 and would then be raised against the rubber cushion 83. The rubber cushion 83 would seal the top edge of the container as it presses the nozzle 61 upwardly in the valve body 59 to open the bottom of the valve. As liquid passes down through the liquid passage 81 and out through the liquid diverter 65 to fill the container, the displaced air in the container passes into the port 63 and upward in the vent tube 55. When the container is full, the container is lowered away from the valve and the return spring 75 forces the nozzle down tightly against the closure 67 to stop the flow of liquid.

Through the use of the flip-flop seal of the present invention, plastic containers of reduced wall thickness can safely be filled without danger of being crushed under the vertical load of the filling nozzle. The flip-flop seal tends to move to the direction of least resistance as the container moves to open the valve and again undergoes a flip-flop transition to the opposite direction of least resistance as the return spring returns the valve to the closed position.

In the above description, only one valve has been discussed. Obviously, in a bottle-filling machine a plurality of valves would be located about the periphery of the liquid container so that more than one bottle can be filled at a time.

In the foregoing description, it will be readily appreciated by those skilled in the art that modifications may be made to the invention, without departing from the concepts disclosed herein. Such modifications are to be considered as included in the following claims, unless these claims by their language expressly state otherwise.

The embodiments of the invention in which an exclusive property or privilege is claimed are defined as follows:

1. A low resistance valve comprising:

a valve body having an axial passage therethrough;

a nozzle having a cylindrical body with a two stepped peripheral portion of reduced diameter near one end, said two stepped portion including a first step portion of reduced diameter on each side of a bottom step portion of even smaller diameter, mounted for sliding movement in said valve body;

a flat, flexible, resilient, annular sealing member, said annular member having opposed major surfaces substantially wider than the thickness of said annular member and carried on said nozzle and having an aperture sized to fit onto the bottom step portion of said two stepped reduced portion of said nozzle forming a liquid-tight seal and forming the liquid-tight seal for said valve between said nozzle and said valve body as said nozzle and said annular sealing member carried on said nozzle undergo sliding movement on said valve body; and a closure for said nozzle, said nozzle being opened by the movement of said nozzle into said valve body;

wherein said flat annular sealing member is adapted to undergo a bellows-type action as said nozzle and said annular sealing member carried by said nozzle change direction of movement on said valve body.

2. A low resistance valve comprising:

a valve body having an axial passage therethrough;

a nozzle having a cylindrical body with a two stepped peripheral portion of reduced diameter near one end, said two stepped portion including a first step portion of reduced diameter on each side of a bottom step portion of even smaller diameter, mounted for sliding movement in said valve body;

a flat, flexible, resilient, annular sealing member, said annular member having opposed major surfaces substantially wider than the thickness of said annular member and carried on said nozzle and having an aperture sized to fit onto the bottom step portion of said two stepped reduced portion of said nozzle forming a liquid-tight seal and forming the liquid-tight seal for said valve between said nozzle and said valve body as said nozzle and said annular sealing member carried on said nozzle undergo sliding movement on said valve body; and a closure for said nozzle, said nozzle being opened by the movement of said nozzle into said valve body;

wherein said flat annular sealing member is mounted on said bottom step and said shoulder steps are wide enough on either side of said bottom step to allow said flat annular sealing member to move in a flip-flop manner toward either shoulder as said nozzle and said annular sealing member carried by said nozzle move in either direction on said valve body without said annular sealing member binding between said nozzle and the wall of the axial passage through said valve body.

3. A low-resistance valve for use with a bottle-filling machine comprising:

a supply tank for holding a liquid to be dispensed;

a valve having a passage therethrough for controlling the flow of liquid from said supply tank;

a nozzle for movement in said passage in said valve for dispensing liquid from said supply tank, said nozzle having an elongated body portion with a two stepped peripheral portion of reduced diameter near one end, said two stepped portion including a first step portion of reduced diameter on each side of a bottom step portion of even smaller diameter, mounted for sliding movement in said valve body;

a flat, flexible, resilient, annular sealing member having substantially parallel opposed major surfaces substantially wider than the thickness of said annular member and carried on said nozzle and having an aperture sized to fit onto the bottom step portion of said two stepped reduced portion of said nozzle forming a liquid-tight seal between said nozzle and said passage through said valve to facilitate movement of said nozzle in said passage; and a closure for said nozzle, said nozzle being opened by the movement of said nozzle into said valve and away from said closure;

wherein said flat annular sealing member is adapted to undergo a bellows-type action as said nozzle and said annular sealing member carried by said nozzle change direction of movement on said valve body.

4. A low-resistance valve for use with a bottle-filling machine comprising:

a supply tank for holding a liquid to be dispensed;

a valve having a passage therethrough for controlling the flow of liquid from said supply tank;

a nozzle for movement in said passage in said valve for dispensing liquid from said supply tank, said nozzle having an elongated body portion with a two stepped peripheral portion of reduced diameter near one end, said two stepped portion including a first step portion of reduced diameter on each side of a bottom step portion of even smaller diameter; mounted for sliding movement in said valve body;

a flat, flexible, resilient, annular sealing member having substantially parallel opposed major surfaces substantially wider than the thickness of said annular member and carried on said nozzle and having an aperture sized to fit onto the bottom step portion of said two stepped reduced portion of said nozzle forming a liquid-tight seal between said nozzle and said passage through said valve to facilitate movement of said nozzle in said passage; and a closure for said nozzle, said nozzle being opened by the movement of said nozzle into said valve and away from said closure;

wherein said flat annular sealing member is mounted on said bottom step and said shoulder steps are wide enough on either side of said bottom step to allow said flat annular sealing member to move in a flip-flop manner toward either shoulder as said nozzle and said annular sealing member carried by said nozzle move in either direction on said valve body without said annular sealing member binding between said nozzle and the wall of the axial passage through said valve body.

* * * * *